United States Patent [19]

Lamb

[11] 4,144,660

[45] Mar. 20, 1979

[54] ADJUSTABLE STRETCHING FRAME

[75] Inventor: Terrence R. Lamb, Chevy Chase, Md.

[73] Assignee: Art Products, Inc., Chevy Chase, Md.

[21] Appl. No.: 823,111

[22] Filed: Aug. 9, 1977

[51] Int. Cl.[2] ..... D06C 3/08

[52] U.S. Cl. ..... 38/102.5; 160/378

[58] Field of Search ..... 38/102.4, 102.5, 102.6, 38/102.7, 102.8, 102.91; 160/378, 404

[56] References Cited

U.S. PATENT DOCUMENTS

| | | | |
|---|---|---|---|
| 82,602 | 9/1868 | Colly | 160/378 |
| 898,047 | 9/1908 | Harford | 38/102.8 |
| 1,443,923 | 1/1923 | Nercam | 38/102.8 |
| 3,482,343 | 12/1969 | Hamu | 38/102.5 |
| 3,830,278 | 8/1974 | Parker | 38/102.91 X |
| 3,978,905 | 9/1976 | de Lama | 160/378 |

*Primary Examiner*—Louis Rimrodt
*Attorney, Agent, or Firm*—Fleit & Jacobson

[57] ABSTRACT

An adjustable stretching frame for stretching sheet materials, particularly canvas paintings, is disclosed. The frame comprises a plurality of individual frame segment members; means for interconnecting the frame segment members with each other to form a frame; means for adjusting the separation between adjacent frames, and means for maintaining the canvas in a spaced apart relationship relative to the front face of the frame. The latter means may comprise a flexible beading mounted on the individual frame segment members. By adjusting the frame segment members in a manner so as to separate them from their adjacent members, thus expanding the overall dimension of the frame, the canvas is stretched over the frame. The stretchable beading is stretched in such a manner as to fill or complete the space between adjacent frame segment members thus maintaining the overall integrity of the shape of the frame. The framing device of the invention is relatively simple in construction yet is particularly suitable for use for mounting very expensive oil paintings or masterpieces and overcomes the difficulties of known frames.

15 Claims, 17 Drawing Figures

FIG. 8
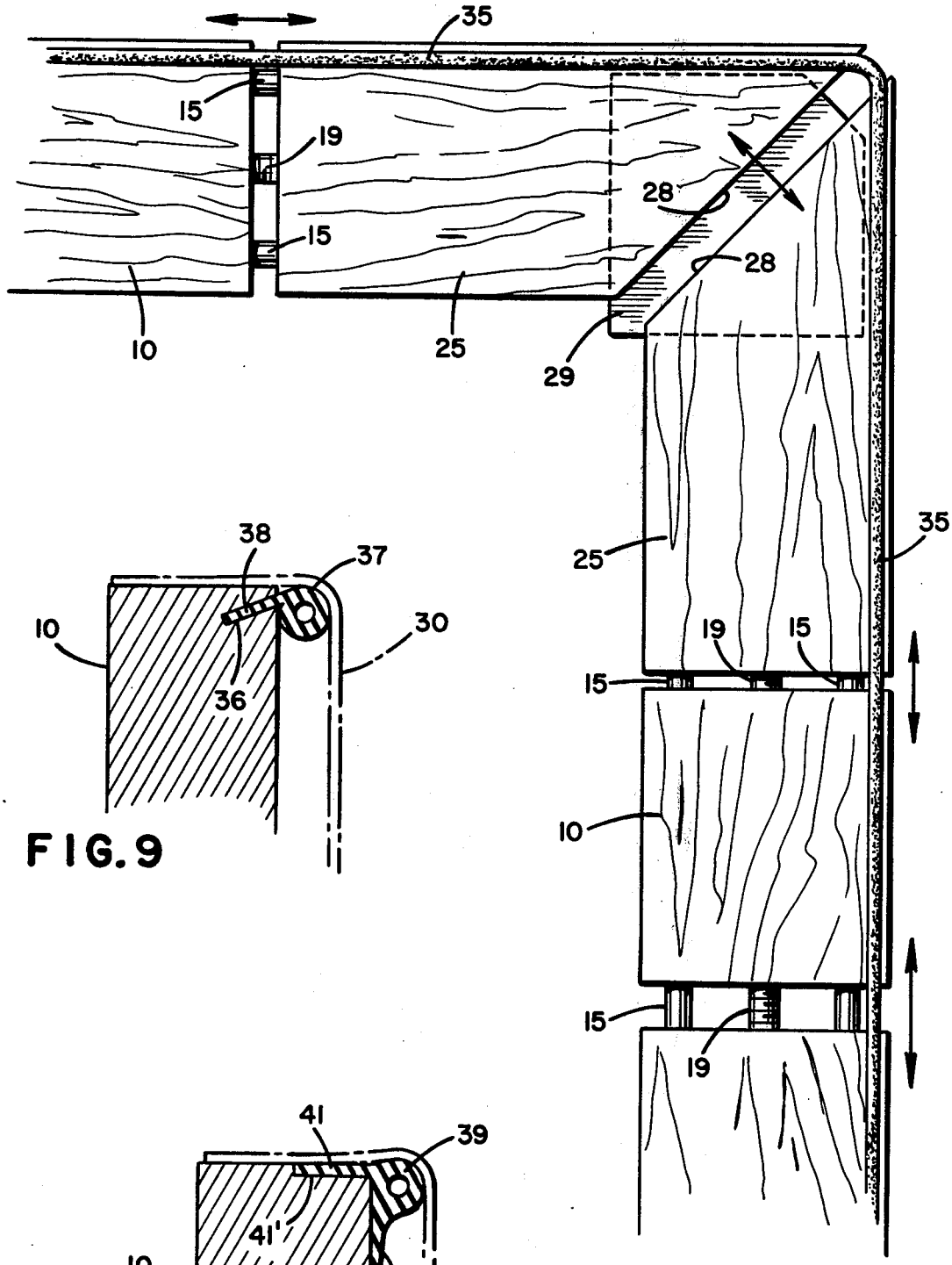
FIG. 9
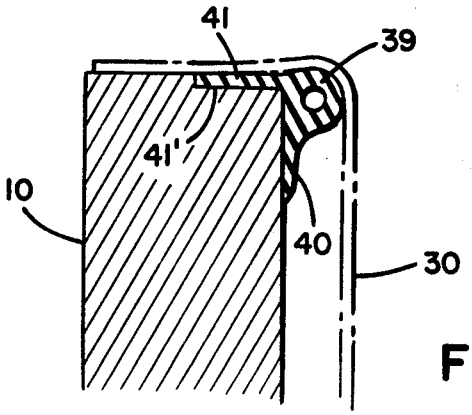
FIG. 10

ADJUSTABLE STRETCHING FRAME

BACKGROUND OF THE INVENTION

1. Field of the Invention

The present invention relates to a framing device for stretching sheet material and, more particularly, to an unique adjustable stretching frame for mounting canvas paintings. The framing device of the invention has particular utility for use in mounting very valuable paintings or masterpieces.

2. THE PRIOR ART

As is well known in the art, canvas paintings are conventionally mounted on wooden frames which are sometimes referred to as canvas frame stretchers. In this regard, typically known frames generally comprise a wooden frame fastened together at the four-corners with braces. The canvas is stretched over the outer edges of the frame and secured to the frame by conventional means, i.e., by staples or nails. Varying techniques for stretching a canvas painting about the frame are known. For example, one technique simply involves stapling a portion of the canvas to the edge of the frame and thereafter draping the canvas over the opposite side of the frame and manually stretching it about the frame. When the canvas is stretched to the required degree, it is stapled to the frame.

In recent years, a number of so-called adjustable frames have also been disclosed. An example of such a framing device id shown, for example, in U.S. Pat. No. 3,482,343. A still further device is shown in U.S. Pat. No. 3,914,887. While the above and further frames are known in the art, they suffer from serious disadvantages and/or deficiencies. One disadvantage lies in the fact that adjustable frames, such as those disclosed by the above noted patents, are very complex from the mechanical standpoint and are thus difficult to use and expensive to manufacture. Also, known adjustable frames may only be adjusted at the corners thereof and are not adjustable along the length and width of the frame. A further problem of presently known and/or commercially available framing devices is that they are not designed such that they may compensate for any expansion and/or contraction of the painting due to changes in temperature or humidity.

The above disadvantages of known frames is particularly acute when mounting very expensive canvas paintings or works of art. It may be briefly noted here that the mounting and/or restretching of an expensive canvas is a highly skilled art involving much expertise. For example, when dealing with a masterpiece, it is very critical that the tension placed on the canvas be closely controlled. This tension will vary widely between paintings. Further, and as noted above, while known frames may have corners which are generally adjustable, they are adjustable only in one direction. This requires that the canvas must be removed along the entire side that is being restretched. Removing the canvas in this manner is a significant problem inasmuch as it is essential, with valuable works of art, that they not be touched even by the tip of one's finger. As is well-known by one skilled in this art, even a fingerprint may well lead to the cracking and deterioration of the painting. In fact, after a masterpiece has been mounted, any further movement of the canvas, as by restretching, may be highly determental and should therefore be avoided. Known frames do not permit this.

A further problem facing this art is the deterioration of a canvas painting with age. While the percise theory, or underlying cause, for the deterioration is not fully known, it has been found that canvas paintings will deteriorate at the point of contact of the painting with the frame. This deterioration is typically along the front outer edges of the frame. It is believed that this damage is due to the reaction of the oils or paint with the material of the frame itself. As a further point with regard to known stretching apparatus or frames, in stretching a canvas over a frame it is very important that the tension exerted between the frame and the canvas be adjustable in order to prevent premature damage to the canvas. This operation requires a great amount of tension to maintain the canvas in a taut condition over the frame. It is also highly desirable, when stretching or restretching certain canvas paintings, (especially those that are aged) to stretch them at different tensions along different portions of the canvas. This is frequently necessary after the canvas has been mounted for a number of years and certain portions of the canvas have become loosened or stretched. With existing frames, it is not possible to retighten or restretch the canvas without moving the canvas from the frame. The present invention provides a truly remarkable adjustable stretching frame that overcomes the above noted deficiencies of known stretching frames.

SUMMARY OF THE INVENTION

It is an object of the present invention to provide a canvas stretching frame that is purely adjustable along the entire periphery of the frame, including the corner portions of the frame when the corner is to be expanded in both directions. It is further an object of this invention to provide an adjustable canvas stretching frame, wherein the corner segments can be separated from each other to adjust the overall dimention of the frame, and thus stretch the canvas that is mounted thereon, while maintaining an overall rectangular shape of the frame.

It is still a further object of this invention to provide an adjustable canvas stretching frame, wherein the various frame segment members that compose the overall frame are interchangeable so that a framer can use any number of separate individual frame segment members arranged in any shape or size desired without having to have a custom-build frame.

It is another object of this invention to provide a canvas stretching frame that is composed of a plurality of separate and individual frame segment members which can be interconnected with each other and adjustable with each other in the shape of a rectangular, or square, frame. The canvas painting is draped over the frame and secured to the rear side of the frame by any suitable means, such as staples. Thereafter, the various frame segment members can be adjusted with respect to each other so that they separate with respect to adjacent frame segment members, thus expanding the overall dimention of the frame and stretching the canvas that is secured thereto. During the separating of the individual frame segment members, gaps between adjacent members will form. The corners of the frame are movable with respect to each thus providing a separation at the corner which is undesirable. It is therefore a further object of the invention to provide a flexible beading that is secured to the frame and which extends along the front face of the frame along the entire periphery of the frame. When the individual frame segment members are separate from each other, to perform the stretching, the flexible beading stretches to maintain the overall integrity of the frame.

In prior art canvas stretching frames, the canvas is stretched directly over the frame and is in intimate contact therewith. Over the years, it is believed that the paint or oil that is used on the canvas reacts with the frame resulting in deterioration of the canvas, and the canvas permanently sticking to the frame. When the frame is desired to be restretched or remounted, it is very difficult to remove the canvas painting from the frame. It is thus, an object of this invention to provide the flexible, stretchable beading mounted on the edge portion of the periphery of the frame in a manner such that it is raised from the front face of the frame so that the canvas is stretched over the upper, raised beading portion to contact as much as possible with the front face of the frame. This arrangement not only prevents deterioration of the canvas, but is also essential in maintaining the rectangular shape of the canvas as it is stretched over the frame.

It is still further an object of this invention to provide an adjustable canvas stretching frame that maintains the required strength characteristics to preclude bending or torsioning of the frame, especially in its expanded position, due to the rather large forces created by the stretching of the canvas. It is another object of this invention to provide tubing extending through the frame stretching members wherein the frame stretching members are slidable along the tubing. The tubing serves as reinforcement to maintain a rigid frame.

BRIEF DESCRIPTION OF THE DRAWINGS

The manner in which the foregoing and other objects are achieved in accordance with the present invention will be better understood in view of the following detailed description and accompanying drawings wherein:

FIG. 8 is a partial sectional view illustrating the stretchable bead provided in one embodiment of the invention;

FIG. 9 is a partial sectional view illustrating the cross-sectional design of the stretchable bead provided by the invention, and the method for mounting same to the frame;

FIG. 10 is a partial sectional view illustrating a further design and embodiment of the stretchable bead provided in accordance with the invention;

DESCRIPTION OF THE PREFERRED EMBODIMENT(S)

As noted above, the present invention relates to an unique canvas stretching frame that is adjustable along the entire periphery of the frame. Broadly speaking for the moment, the adjustable frame of the invention comprises: a plurality of frame segment members including adjustable corner members; means for interconnecting the frame segment members with each other to form a rigid, yet adjustable frame structure; means for adjusting the separation between adjacent frame segment members and means, mounted on or formed integral with the frame, for maintaining the canvas in a spaced apart relationship from the front face of the frame. In a particularly advantageous embodiment, the means for maintaining the canvas in a spaced apart relationship relative to the front face of the frame comprises a stretchable bead mounted on the frame and, adjacent the outer edge of the frame, such that when adjacent frame members are separated, the flexible bead is stretched between the adjacent frame members.

Figure 1:
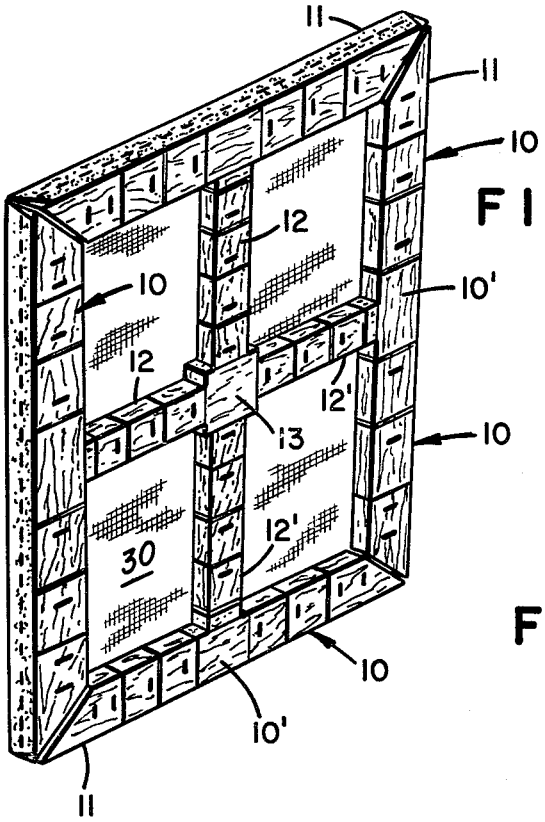
FIG. 1 is a perspective view of a first embodiment of the adjustable stretching frame of the instant invention.
Figure 2:
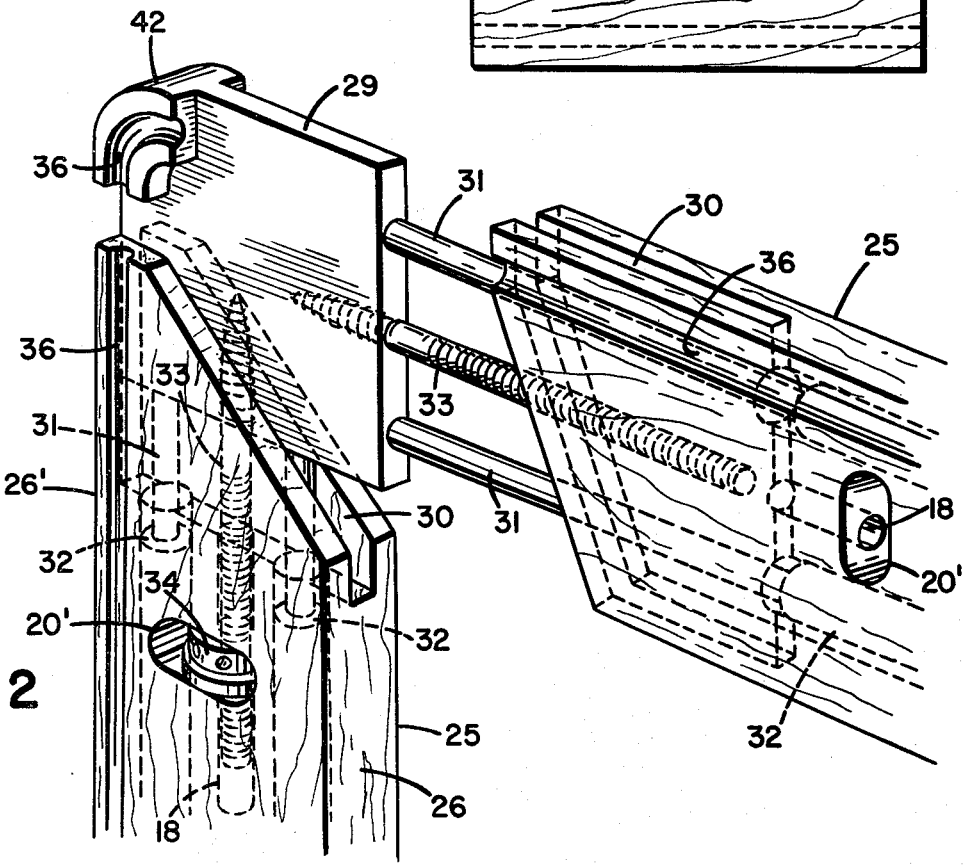
FIG. 2 is a partial perspective sectional view illustrating the adjustable corner frame segments and plates of the frame of the invention.
Figure 3:
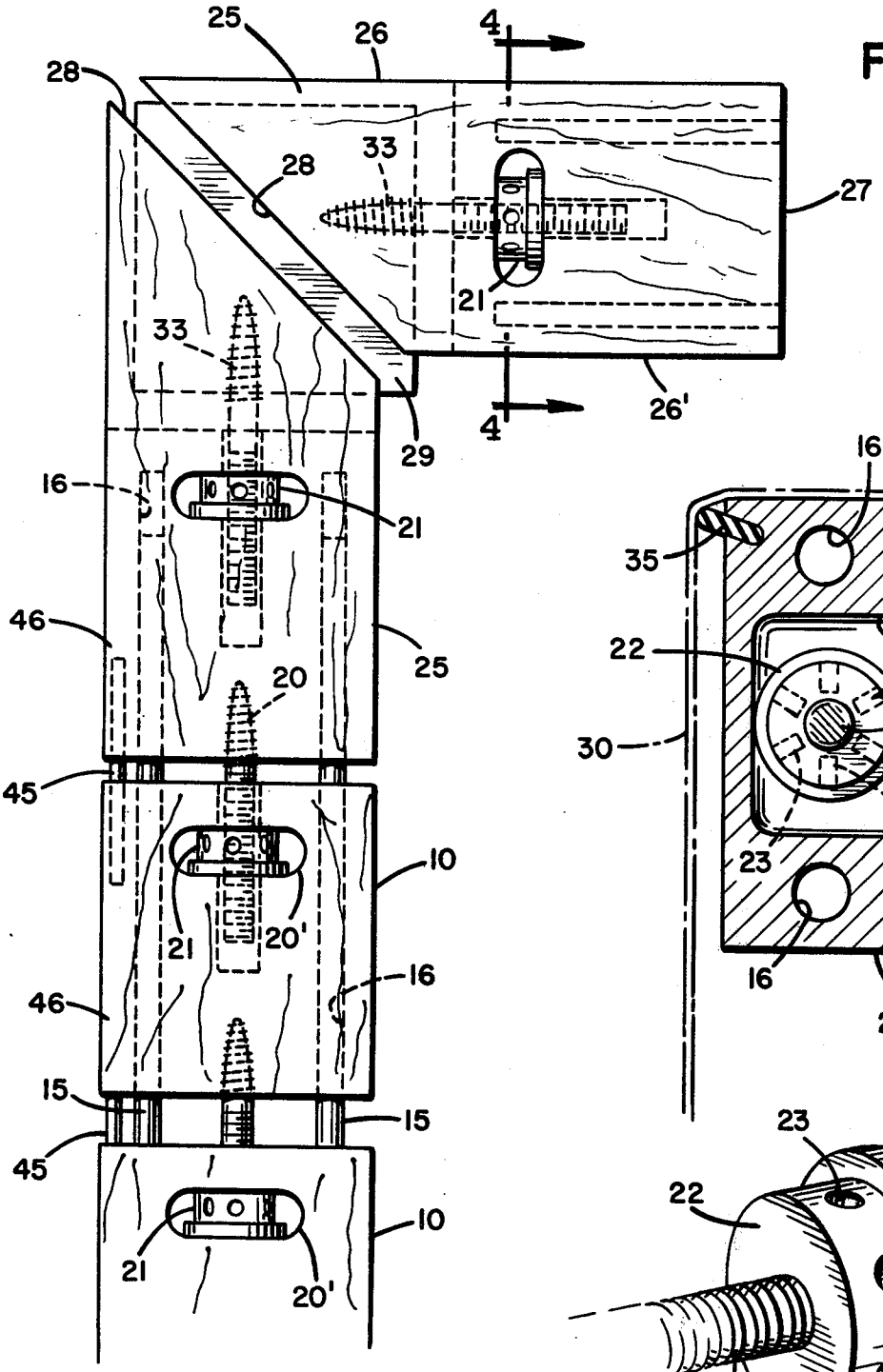
FIG. 3 is a partial sectional view illustrating the structural means for interconnecting and adjusting adjacent frame segment members provided by the instant invention.

Turning now to more specific details of the invention, and with reference to the drawings, as shown in FIGS. 1–2, the unique frame structure of the invention comprises a plurality of frame segment members indicated generally at 10. The frame further includes corner segments 11 which, as to be discussed in more detail hereinafter, can be separated from each other to adjust the overall dimension of the frame and thus stretch the canvas while at the same time maintaining the overall shape of the frame. The individual frame segments are interchangeable so that a framer may use any number of separate individual frame segment members arranged in any predetermined size or shape without having to have a custom-build frame. It has been found that the length of the individual segments 10 may be varied within a wide range and are preferably on the order of from about 2 inches to 10 inches in length. For a standard size and/or relatively inexpensive frame, however, the segment 10 may be relatively long in length, i.e., greater than 10 inches in length or may comprise a single piece, with only the corners being adjustable. The use of a number of different relatively short frame segment members permits more extensive adjustments and is preferred for more expensive paintings where close control of the tension involved is critical. The frame device of the invention is thus a significant advance in the art both for the less expensive paintings as well as masterpieces.

Figure 1A:
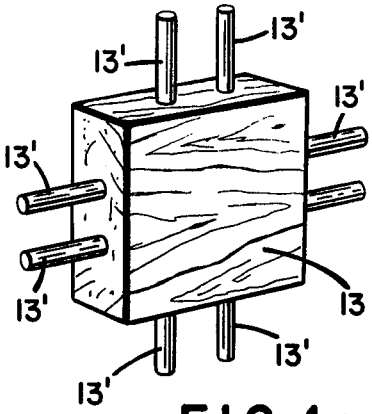
FIG. 1*a* is a perspective view illustrating the centering member employed for interconnecting the cross-framing provided in the embodiment of FIG. 1.

In the embodiment shown in FIG. 1, there is further provided interconnecting cross-frame segment members 12 which include a centering member 13 (see FIG. 1*a*) having rods 13' for interconnecting the cross-frame segments. This structure serves to enhance the overall strength of the frame. The strength provided by the basis construction of the frame itself however, may render the use of cross-bracing unnecessary. This would be particularly true for less expensive canvas paintings.

Figure 1B:
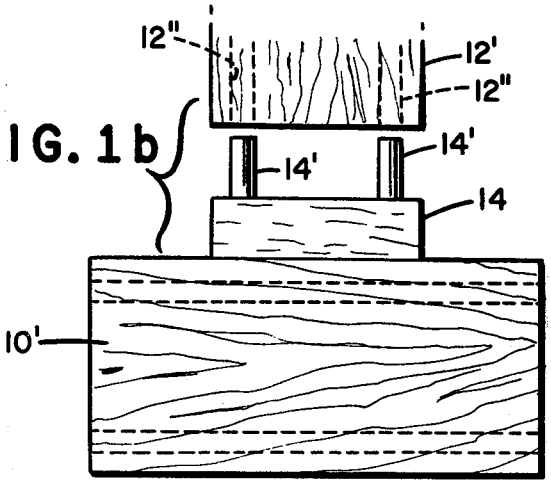
FIG. 1*b* is a partial sectional view illustrating a preferred embodiment for interconnecting the cross-framing provided by the invention.

If cross-bracing is emloyed, the frame segment members 10' which receive the corresponding cross-bracing segment members 12', are substantially identical in structure to frame segment members 10 except that each frame segment member 10' includes, as shown in FIG. 1b, a raised portion 14 having tubing or rods 14' for mounting within openings 12'' provided within each of crossframe segment 12. Alternative embodiments may be provided, however, as for example, the raised portion 14 may include channels adapted to receive rods affixed to the crossbracing segment members 12.

Figure 4:
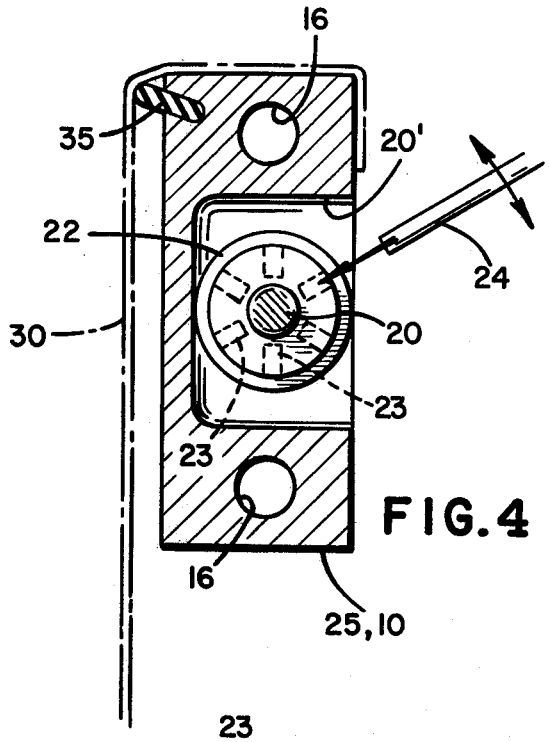
FIG. 4 is a sectional view taken along the line 4—4 in FIG. 3.
Figure 5:
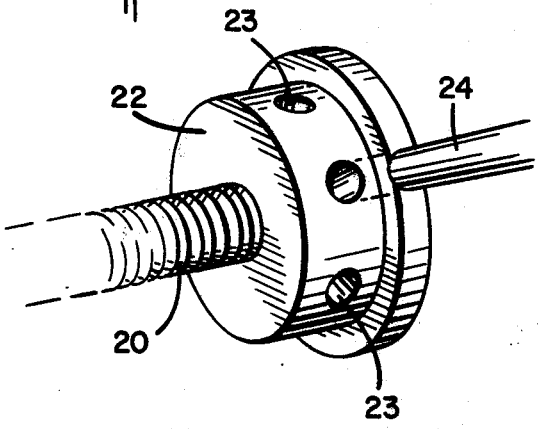
FIG. 5 is an enlarged perspective view of the bolt means shown in FIG. 4.
Figure 6:
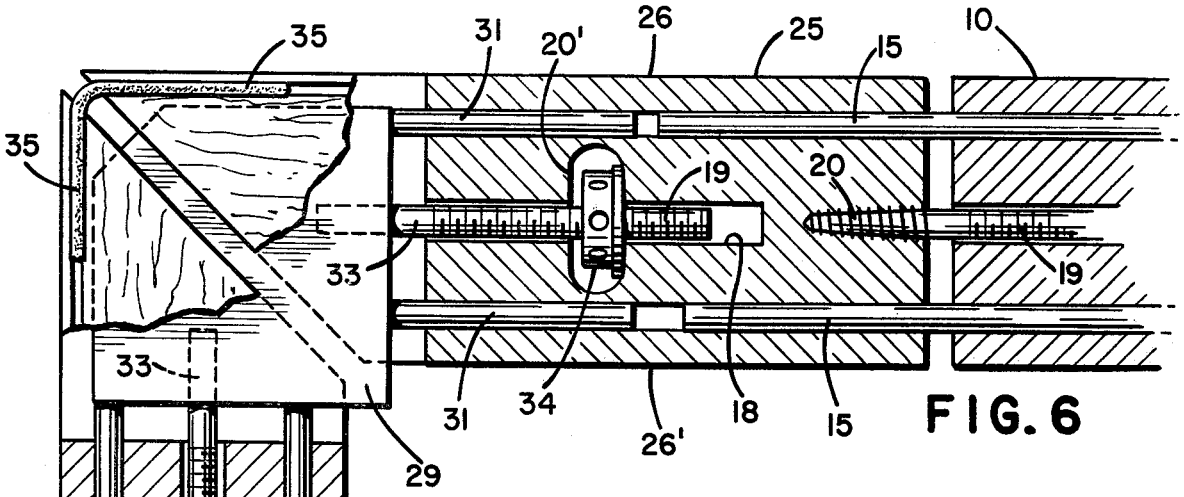
FIGS. 6 and 7 are partial sectional views illustrating the structure for interconnecting and adjusting the corners and adjacent frame segment members in accordance with a further embodiment of the invention.
Figure 7:
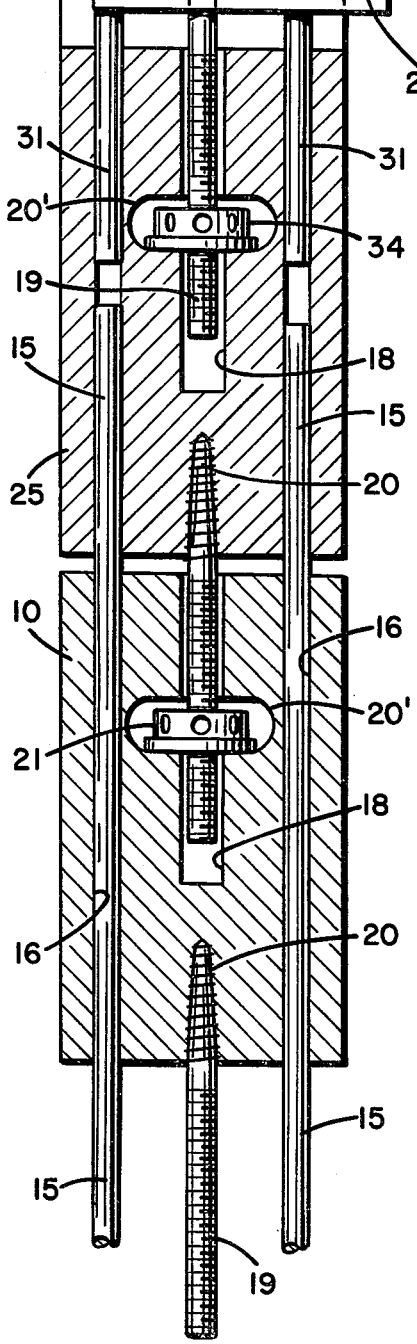
Figure 7:
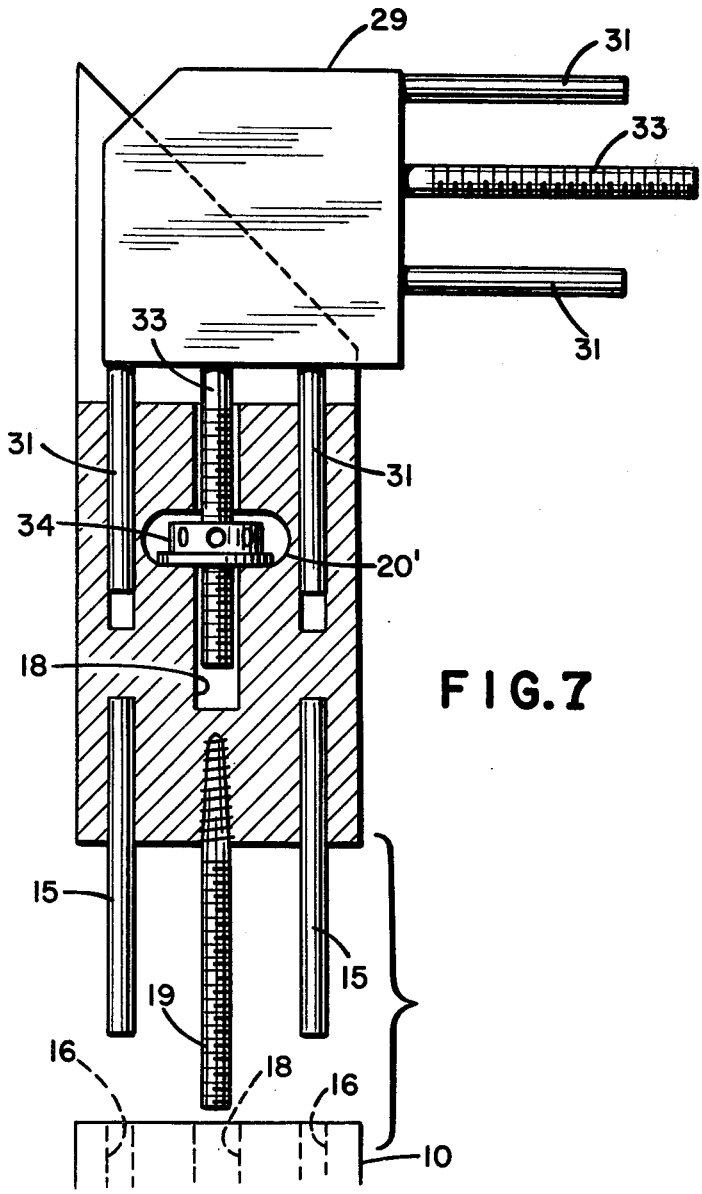

With reference now to FIGS. 3–6, as noted above, means are provided for interconnecting the frame segment members as well as for adjusting the separation between adjacent frame segment members. In this regard, the frame segment members 10 are interconnected by way of elongated rods or tubes indicated generally at 15, which are adapted to be placed or fitted within channels or aperture 16. These apertures may be continuous throughout the length of the frame as shown in FIG. 6 for receiving the rod or tube 15 that is of a sufficient length to connect two or more frame segment members. In the alternative, the aperture or channel 16 may extend through only a portion of the frame segment members and be adapted to receive a tube or rod (15) that is permanently affixed or secured to an opposing frame segment member. This embodiment is illustrated in FIG. 7. In the embodiment shown in the drawings, the channels 15 are located along opposite side edges of the frame segment members. As should be readily appreciated by those skilled in the art, however, any number of these channels may be provided, with the number and size thereof generally depending on the size of the frame and the strength required for its intended use.

In addition to the interconnecting rods and mating channels, means are also provided for adjusting the separation between adjacent frames. This structure includes channels 18 positioned essentially at the center of each frame segment member 10 and adapted to receive a threaded bolt 19 which is affixed, as by a tapered screw 20, to an adjacent frame segment member. As shown, e.g., in FIGS. 3 and 6, an aperture 20' is also formed in the rear face of the frame segments 10, which aperture extends into the channel 18. In this manner, a conventional tool may be employed for turning a threaded nut 21 on the threaded bolt so as to adjust the separation between adjacent frame segment members. In the embodiment of FIGS. 4 and 5, the nut may comprise a threaded circular member or nut 22 which includes openings 23 positioned around the periphery of this member for receiving a rod 24. Simply inserting and rotating the rod 24 causes displacement of adjacent frame members.

Figure 11B:
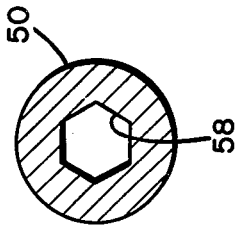
FIGS. 11, 11*a*, 11*b* and 11*c* are partial sectional views illustrating structural means for adjusting adjacent frame segment provided by the invention.
Figure 11C:
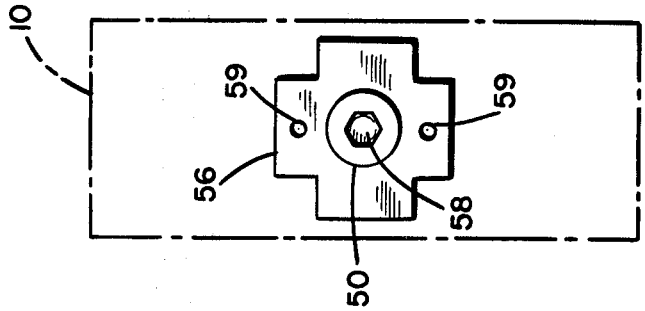
Figure 11:
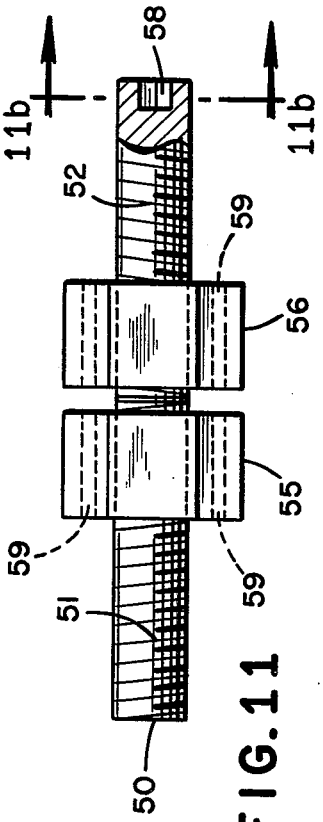
Figure 11A:
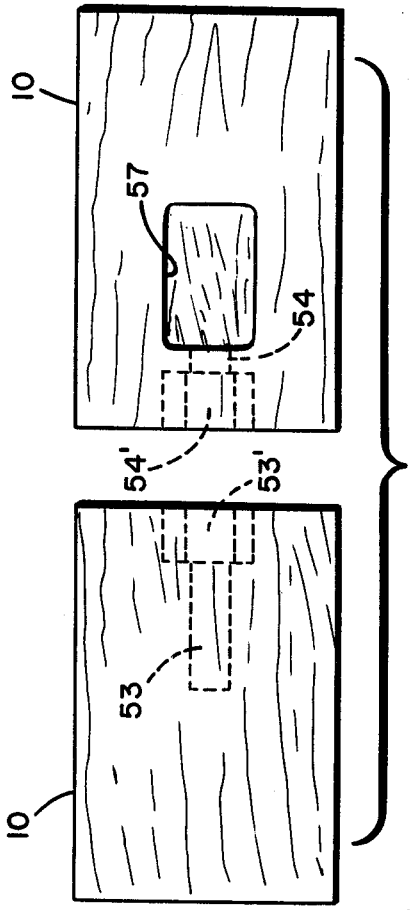

As an alternative for the threaded nut-bolt arrangement, as shown, e.g., in FIGS. 3–6, and as a further particular advantageous embodiment of the present invention, the means for adjusting the separation between adjacent frame segments may comprise a turnbuckel type structure, such as illustrated in FIG. 11. This structure comprises an elongated shaft or rod 50 having opposing left-right threading 51 and 52 which are adapted to be received within aperatures or channels 53 and 54 positioned at the ends of mating or adjacent frame segments as shown in FIG. 11. Each end of the opposed threaded portions include internally threaded collars 55 and 56 which, as shown in FIG. 11a, are adapted to be positioned within a mating groove or slot formed or provided at the ends of the adjacent frame segments. The collars are fitted and secured within the grooves or slots (53',54') to prevent rotation or movement thereof by conventional means, i.e., small screws or nails. In the practice of this embodiment, an opening 57 would be formed in one of the adjacent frame segments. This opening would extend from the rear face of the frame and into the channel or groove (53 or 54). See FIG. 11a. In operation, the adjacent frame segment members would be separated by inserting a convention ratchet wrench (not shown) within a socket 58 provided at the end of the corresponding shaft 50. In this manner, the canvas, once mounted, may be easily stretched by a simple turning of the handle of the socket wrench. Such operation would obviously involve a minimum of time and effort, and little mechanical expertise. FIGS. 11b and 11c illustrate a preferred cross-sectional design for the rod 50, socket 58 and collars 55 and 56, respectively. Openings 59 are adapted for receiving a small screw for affixing to the frame segment member 10.

As previously noted, the canvas stretching frame is adjustable along the entire periphery of the frame. A particularly unique aspect of the invention includes the design of the corner portions of the frame which may be separated from each other to adjust the overall dimensions of the frame as well as to stretch the canvas that is mounted thereon. In this regard and with reference to FIGS. 2, 3 and 6, the frame includes corner frame segment members 25, each corner member being of generally trapezoidal shape and having two parallel sides 26 and 26'; a furthermost edge 27 and a side edge 28 which extends at a 45° angle with the parallel sides 26 and 26'. The individual corner frame segment members are adapted to mate with each other when the frame is assembled as shown in the drawings.

In this regard, means are provided for interconnecting the corner frame segment members which comprise four substantially square-shaped corner plates 29. Each corner plate has a thickness less than the thickness of the corner frame segments 25 and is adapted to be fitted or mounted within a groove 30 formed in the angled side edge 28. The corner plates 29 should be constructed of a material that has a greater strength than that of the individual frame segment members, i.e., wood, light weight metals such as aluminum, etc. Thus, the material forming the corner plate may comprise a synthetic product or plastic, such as high impact polystyrene, polyethylene, PVC, etc. Elongated rod members 31 are formed integral with each corner plate 29. As shown, e.g., in FIG. 2, rods 31 are adapted to be fitted into channels 32 formed in each corner frame segment member 25. The corner plates 29 further include a threaded bolt 33 formed integral therewith and adapted to receive a threaded nut 34. See, for example, FIG. 6. In this matter, the corners of the frame may be easily adjusted so as to vary the overall dimensions of the frame and to stretch the canvas while maintaining the overall shape of the frame. It should be further apparent that the unique structure permits independent adjustments, both horizontally and vertically. At this point, it may also be noted, that, in prior art frames, damage to the paintings caused by the stretching most often occurs at the corners thereof. The present invention overcomes this significant difficulty.

In the practice of the invention, the individual frame segment members are interconnected in the manner aforesaid and the canvas indicated generally at 30 in FIG. 1 is mounted onto the front face of the frame and secured to the rear side thereof by conventional means, e.g., as by stapling. By adjusting the individual frame segments by way of the threaded nut 34, the individual segment members are separated from adjacent members thereby expanding the overall dimension of the frame. The latter serves to stretch the canvas over the frame. In conventionally known frames, the canvas is stretched directly over the frame and is in intimate contact therewith. However, as time passes, the canvas (more particularly the paint or oil that is used on the canvas) will react with the frame with results in the deterioriation of the canvas. The canvas may also become permanently stuck to the frame. Thus, when the frame is to be restretched or remounted, it is very difficult to remove the canvas from the frame. In accordance with the present invention, however, there is provided a stretchable beading which is mounted near the edge of the periphery of the front of the frame and is raised or extends from the front face so that the canvas is stretched over the raised beading. In this manner, contact with the front face of the frame is substantially reduced. This arrangement not only prevents deterioration of the canvas but, also has been found to be essential for maintaining the rectangular shape of the canvas as it is stretched over the frame.

In this regard and with reference again to the drawings, and more specifically FIGS. 2 and 8, the flexible bead 35 comprises a continuous beading that is made of a material which has the properties which permit it to stretch in tension while at the same time not being deformed in compression. Various synthetic and natural rubbers have been found to be satisfactory for this purpose, such materials and their properties being well known in the art. As best shown in FIG. 2, a notch 36 is formed along the front face of the individual frame segment members 10 for mounting the flexible bead to the frame segment members. In a particularly advantageous embodiment, the notch is angled from the top outer surface of the frame segments, i.e., the side edge of these segments, in a direction inwardly away from the edge. The stretchable beading may be substantially rectangular shape or, as shown in FIG. 9, may have a circular cross-sectional portion 37 for supporting the canvas and a flange portion 38 which is adapted to be inserted into the notch formed in the frame. In accordance with the further embodiment, as illustrated in FIG. 10, the beading may have a substantially circular cross-sectional portion 39 and two opposing flange portions 40 and 41, the latter being substantially at right angles to each other. If this embodiment is employed, a recess or notch 41' may be formed along the outer edge of the individual frame segment members. The beading may be secured to the frame by conventional means. Preferably, the notch is smaller than the beading so as to form a tight fitting. In this regard in the embodiment shown in FIG. 6, the notch is formed along the outer edge of the individual frame segment members 10 and the corner frame segments 25. As an alternative to this design, the corner plates 29 may also include a raised portion 42 which is formed integral with the corner plates and positioned at the outer corner thereof as shown in FIG. 2. The notch 36 would then be formed within this raised portion in the manner illustrated.

Figure 12:
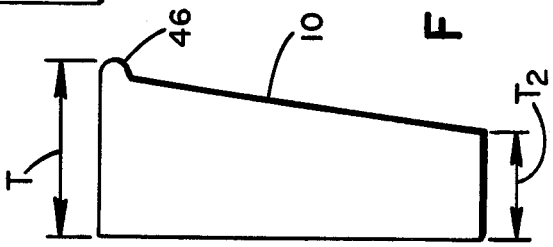
FIG. 12 is a cross-sectional view in elevation of a preferred cross-sectional design for the individual frame segment members provided by the invention.

As a further embodiment in accordance with the present invention, the individual segment members forming the frame may also have a cross-sectional design such that the outer edge or periphery of the front of the frame is itself raised to the extent that the thickness of the frame is greatest at its outermost edge. This embodiment is illustrated in FIG. 12. As shown, the front face of the frame tapers from an initial thickness T, at the outer edge of the frame to a smaller dimension T2 along the inside edge of the frame. In this manner, the canvas painting being stretched over the frame, contacts only the outermost edge or raised portion T. If this embodiment is employed, the raised portion may be formed of the same material as the frame itself or may comprise a flexible tip formed integral with the frame as shown in FIG. 12. The tip would be formed of the same material as the flexible beading discussed hereinabove. In this embodiment, a small rod or tube 45, is mounted within an aperture 46 formed at the outer edge of the front face of the frame segments (and adjacent the opposing ends thereof) so that when the frame is stretched, the rod or tube substantially fills or closes any space formed between the adjacent frame segment. See FIG. 3.

From the above, it will be seen that the present invention provides a truly remarkable canvas stretching frame that is adjustable over the entire periphery of the frame. The frame is composed of a plurality of separate and individual frame segments which may be interconnected and adjusted relative to adjacent segments. The canvas painting is draped over the frame and secured to the rear side of the frame by any suitable means. Thereafter, the frame segment members are adjusted with respect to each other to expand the overall dimensions of the frame and to stretch the canvas. The flexible and stretchable beading that is provided in accordance with the invention extends along the full front face of the frame such that when the individual frame segments are separated from each other, the flexible beading stretches to maintain the overall integrity (i.e., shape) of the frame. Unlike prior art frames, the frame of the present invention is particularly suitable for very expensive paintings and provides a framing apparatus wherein after a number of years, the canvas may be restretched and the painting remounted with a minimum of difficulty and damage to the canvas itself. While particularly preferred embodiments have been shown, it should be expressly understood that such embodiments have been given for illustrative purposes only and are not intended to limit the scope of the present invention as further defined by the appended claims.

What is claimed is:

1. An adjustable stretching frame for stretching canvas paintings comprising:

a plurality of frame and corner segment members having a front face over which a canvas is to be stretched;

means for interconnecting said frame and corner segment members with each other to form a rectangular frame;

means for adjusting the spacing between adjacent frame and corner segment members; and means for maintaining a canvas to be stretched on the frame in a spaced apart relationship from the face of said frame comprising:

(a) a stretchable bead, and (b) means for mounting said stretchable bead to said frame and corner segment members adjacent to an edge of said segment members, wherein when adjacent frame segment members are separated by said adjustment means, said stretchable bead is stretched between the adjacent frame segment members.

2. The adjustable frame in accordance with claim 1 wherein said means for mounting said stretchable bead to said frame segment members comprises a notch formed at the edge of said frame segment members and along the front face thereof, said notch of each of said frame segment members aligned with the notch of an adjacent frame segment members when said frame members are interconnected to form a rectangular frame.

3. The adjustable frame in accordance with claim 2 wherein said notch is angled from the top face of said frame segment members adjacent the edge of said frame segment members in a direction inwardly from the edge of said frame segment members.

4. The adjustable frame in accordance with claim 2 wherein said stretchable bead is substantially rectangular in shape and having rounded corners, and wherein said notch has a depth less than the width of said stretchable bead whereby said bead extends above the face of said frame segment members when inserted in said notch to support the canvas to be mounted thereon.

5. The adjustable frame in accordance with claim 2 wherein said stretchable bead has a circular cross-section portion for supporting a canvas and a flange portion extending from said circular cross-section portion, said flange portion being adapted to be inserted in said notch of said frame segment members.

6. The adjustable frame in accordance with claim 1 wherein said stretchable bead is made of a material having the property of stretching in tension and not deforming in compression.

7. The adjustable frame in accordance with claim 3 wherein said stretchable bead comprises a material selected from the group consisting of neoprene, rubber and nylon.

8. The adjustable frame in accordance with claim 1 wherein said means for mounting said flexible bead to said frame segment members comprises a notch formed along the outer side edges of said frame segment members and adjacent the front face thereof, said stretchable bead having a right angle portion wherein one leg of said right angle portion is adapted to be inserted in said notch.

9. The adjustable frame in accordance with claim 1 and further comprising a plurality of cross-frame segment members; means for interconnecting said cross-frame segment members comprising a center member; means for interconnecting said plurality of cross frames perpendicular to each other, and means for interconnecting said cross-frame segment members with said frame segment members that form the rectangular frame.

10. An adjustable stretching frame for stretching canvas paintings comprising:

(1) a plurality of frame segment members having a front face over which a canvas is to be stretched;

(2) means for interconnecting said frame segment members with each other to form a rectangular frame;

(3) means for adjusting the separation between adjacent frames;

(4) means for maintaining a canvas to be stretched on the frame, spaced apart from a face of said frame comprising:

(a) a stretchable bead, and (b) means for mounting said flexible bead to said frame segment members adjacent to an edge of said frame segment member, wherein when adjacent frame segment members are separated by said adjusting means, said stretchable bead is stretched between the adjacent frame segment members; and (5) said frame segment members further comprising a pair of corner frame segments for forming each corner of said stretching frame, each of said corner frame segments having a trapezoidal shape with two parallel side edges, a perpendicular edge located at a remote position from the corner of the stretching frame, and a side edge nearest the corner extending at a 45° angle with respect to the parallel sides, whereby the side edges of each corner frame segment are adapted to mate with each other along the corresponding side edges extending at said 45° angle.

11. The adjustable frame in accordance with claim 10, wherein said corner frame segment members are provided with a groove in the angled side edges thereof, said adjustable frame further comprising four substantially square corner plates, each of said corner plates having a thickness less than the thickness of said corner frame segment members and adapted to be fitted into the corresponding groove of each of said corner frame segment members, whereby the said corner frame segment members and said corner plates serve to permit slidable adjustment to expand the corners of said frame.

12. The adjustable frame in accordance with claim 11, wherein said means for slidably adjusting said corner frame segment members with relation to said corner plate mounted within said groove of said corner frame segment members comprises a threaded bolt mounted to one side of said corner plate and channel means within each of said corner frame segment and adapted to receive a threaded nut to provide slidable adjustment of said corner frame segment members.

13. The adjustable frame in accordance with claim 10, wherein said means for adjusting separation between adjacent frame segment members comprise a threaded bolt affixed to one side of a frame segment member; a channel means for receiving said threaded bolt in the opposing side edge of said frame segment members; means for arranging adjacent frame segment members, whereby the threaded bolt means of one frame segment member enters into said channel of the adjacent frame segment member; means for securing said threaded bolt means within said channel means; said means for securing said threaded bolt means comprising a slot formed in the rear face of said frame segment members extending through the channel means; and a threaded nut means within said slot for receiving said theaded bolt means, whereby rotation of said threaded nut means along said threaded bolt adjustable displaces the adjacent frame segment members with each other.

14. The adjustable frame in accordance with claim 10, wherein said means for interconnecting said frame segment members comprise a pair of dowel members and a pair of complementary dowel passages positioned on opposite side edges of each of said frame segment members, whereby, when said dowel members are inserted in said dowel passages, said frame segment members are slidably interconnected with mating or opposing frame segment members.

15. The adjustable frame in accordance with claim 10, wherein said corner plates include a pair of rods, each pair of rods extending from two side edges and having a length less than the length of corner frame segment members, said corner frame segment members having a pair of rod receiving passages adapted to receive each of said rods formed on the corresponding and mating corner plates.

* * * * *